US005299863A

United States Patent [19]

Albright, Jr.

[11] Patent Number: 5,299,863

[45] Date of Patent: Apr. 5, 1994

[54] REFRIGERATOR WITH SLIDING INTERIOR FRAME

[76] Inventor: Harold D. Albright, Jr., P.O. Box 221294, Charlotte, N.C. 28222

[21] Appl. No.: 791,890

[22] Filed: Nov. 14, 1991

[51] Int. Cl.[5] ..... F25D 11/00

[52] U.S. Cl. ..... 312/404

[58] Field of Search ..... 312/404, 408, 249.9, 312/334.6, 334.14, 334.28, 351.3, 298, 308, 330.1

[56] References Cited

U.S. PATENT DOCUMENTS

| | | | |
|---|---|---|---|
| 729,859 | 6/1903 | Von Der Groeben | 312/334.28 |
| 1,281,923 | 10/1918 | Fales | 312/334.28 |
| 1,589,064 | 6/1926 | Gearhart | 312/308 |
| 2,103,885 | 12/1937 | Whalen | 312/404 |
| 2,549,664 | 4/1951 | Collins | 312/408 |
| 2,549,879 | 4/1951 | Amore | 312/408 |
| 2,950,158 | 8/1960 | Harmon | 312/330.1 |
| 3,984,163 | 10/1976 | Boorman, Jr. et al. | 312/330.1 |

*Primary Examiner*—Peter R. Brown
*Assistant Examiner*—Janet M. Long
*Attorney, Agent, or Firm*—Shefte, Pinckney & Sawyer

[57] ABSTRACT

A refrigerator/freezer having a sliding unit in its interior refrigeration portion in the form of several shelves in superimposed relationship with one another mounted to the common frame. A track assembly is included for slidably mounting the slidable interior unit in the refrigerator in lieu of the stationary shelves which are normally mounted in the body of a refrigerator. The sliding out interior unit additionally includes a pair of "crisper"-type bins slidably mounted on tracks on the bottom of the interior unit. The entire interior unit is normally slid fully into the refrigerator to support items within the closed refrigerator.

4 Claims, 5 Drawing Sheets

REFRIGERATOR WITH SLIDING INTERIOR FRAME

FIELD OF THE INVENTION

The present invention generally relates to refrigerators and more particularly to refrigerators having features for facilitating easy shelf access.

BACKGROUND OF THE INVENTION

In a household or commercial refrigerator, it is desirable to provide easy access to the interior shelves in both the refrigeration and freezing compartments. The ability of refrigerator shelves to slide horizontally into and out of the interior of the refrigerator enables the consumer to more conveniently reach items at the back at the shelf as well as to prevent any breakage or spillage of items on the shelves. Easier access saves time and effort in reaching the various items stored in the refrigerator and also saves energy because of the shorter time needed to keep the refrigerator open to retrieve various items. In addition, the ability for shelves to slide out of the refrigerator allows for easy cleaning of the refrigerator and the shelves.

An example of an attempt to facilitate access to items stored in a refrigerator can be seen in U.S. Pat. No. 3,984,163 to Boorman, Jr., et al. The Boorman patent discloses a shelf assembly having a cantilever support frame and a sliding shelf which may be removed from the frame. The frame includes a pair of shelf guides or tracks.

U.S. Pat. No. 4,729,613 to Tromble et al. discloses a household refrigerator pan assembly for supporting a pair of "crisper"-type drawers for sliding movement. These patents do not however provide for easy access to the shelves of the refrigerator by allowing the shelves and crisper bins to slide out from the interior of the refrigerator.

SUMMARY OF THE INVENTION

It is an object of the present invention to provide easy access to shelves and bins within a refrigerator or freezer.

It is another object of the present invention to facilitate cleaning of the interior shelves of a refrigerator or freezer.

It is still another object of the present invention to provide a refrigerator with energy saving features due to the ease with which a consumer can locate items within the refrigerator.

The instant invention relates to a refrigerator/freezer having a sliding frame in its interior refrigeration portion in the form of several shelves in superimposed relationship with one another mounted to the common frame. The invention also includes a track assembly for slidably mounting the slidable interior unit in the refrigerator in lieu of the stationary shelves which are normally mounted in the body of a refrigerator. The sliding out interior unit additionally includes a pair of "crisper"-type bins slidably mounted on tracks on the bottom of the interior unit. The entire interior unit is normally slid fully into the refrigerator to support items within the closed refrigerator.

For easy access to the items in the refrigerator, the sliding interior unit can be slid outwardly along the track support so that a major portion of the slide cartridge unit is supported forwardly of the interior compartment of the refrigerator. Additionally, the separate sliding tracks which support the crisper-type bins permit these bins to be slid forwardly beyond the front of the other shelves of the sliding interior unit for access to the bins through their tops. The frame of the interior unit contains notches to allow for variation in the height of the shelves. Optionally, a support frame may be mounted at the lower portion of the interior unit which is spring loaded and releases when the interior unit is extended. The support member engages the ground beneath the interior unit to prevent any potential tipping of the refrigerator. An interior unit similar to one described with respect to the refrigeration portion of the refrigerator/freezer may also be employed in the freezer portion of the refrigerator/freezer.

Further features and advantages of the present invention will be apparent from the drawings and the following detailed description of the preferred embodiment.

DETAILED DESCRIPTION OF THE INVENTION

Figure 1:
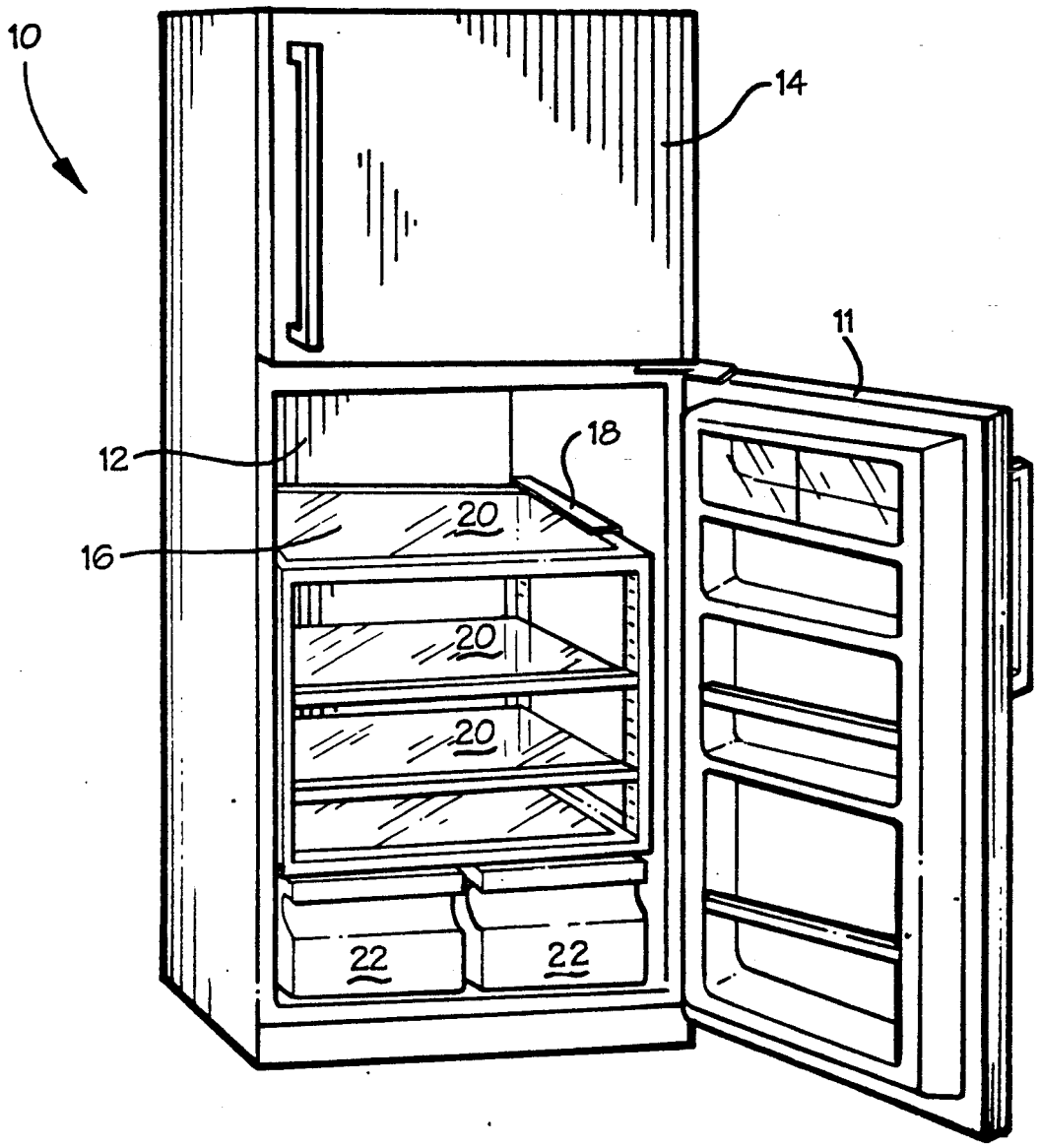
FIG. 1 illustrates a first embodiment of the present invention.

Referring now to FIG. 1, a first embodiment of the present invention is shown. A standard refrigerator/-freezer 10 is shown with the refrigerator door 11 in its open position and the freezer door 14 in its closed position. The interior of the refrigeration section 12 is seen to contain an interior unit 16 having a series of adjustable shelves 20. The interior unit 16 is shown in its first non-extended position. The interior unit may be set on upper guide rails 18 and lower guide rails 28 (seen in FIG. 5). Also shown are crisper-type bins 22 attached to the interior unit 16.

Figure 2:
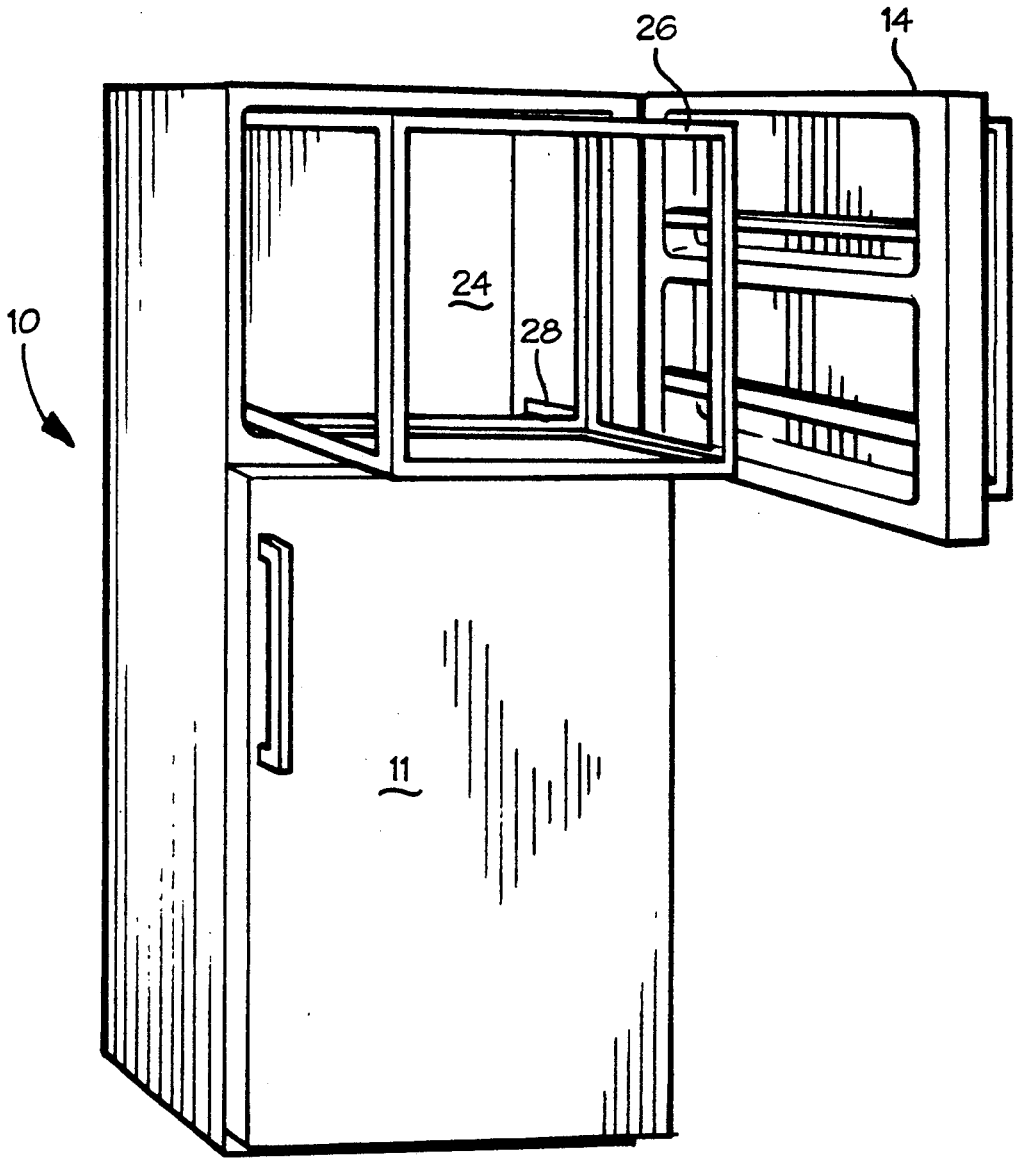
FIG. 2 illustrates a second embodiment of the present invention.

Referring now to FIG. 2, a second embodiment of the present invention is shown. In this embodiment, the freezer section 24 is shown to contain an interior unit 26 which may or may not contain a series of adjustable shelves within the unit. The interior unit 26 may be carried on at least one pair of lower guide rails 28 and may also be carried by a pair of upper guide rails 18 (shown in FIG. 5).

Figure 3:
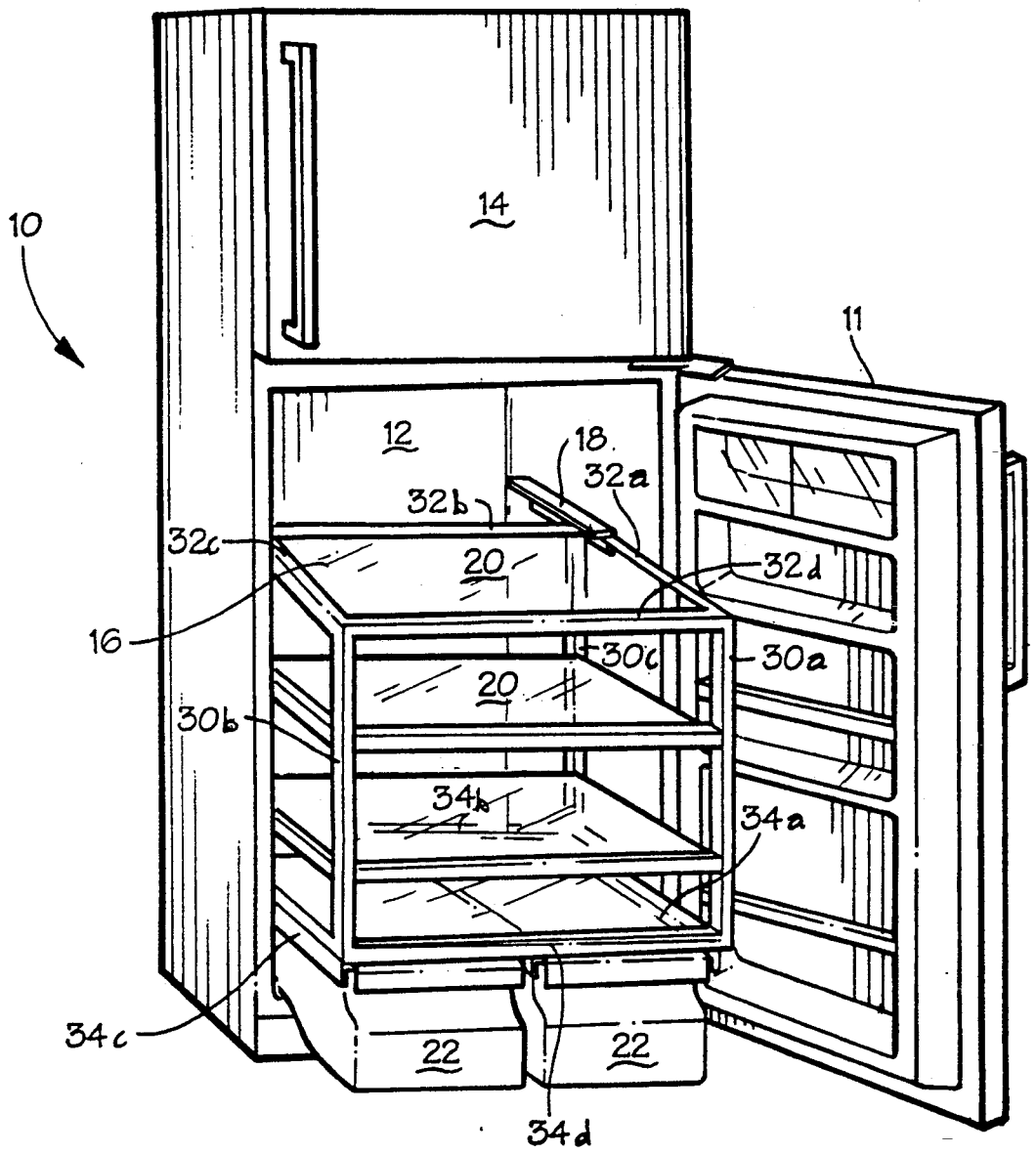
FIG. 3 illustrates the first embodiment of the present invention with the interior unit in the extended position.

Referring now to FIG. 3, the first embodiment of the present invention is shown in its second, extended, position. Here, the interior unit 16 is shown in its extended position along upper guide rails 18. The interior unit is comprised of a frame having four vertical posts 30A, 30B and 30C (the fourth vertical post is hidden). The four vertical posts are connected by an upper and lower set of support bars 32A, 32B, 32C and 32D and 34A, 34B, 34C and 34D, respectively. The upper support bars 32A and 32C are connected to upper guide rails 18 in order to connect slidably the frame to the guide rails for horizontal movement of the frame between the first, non-extended, position shown in FIG. 1 and the second, extended, position shown in FIG. 3. Also contained on the support bars of the interior unit 16 are devices for preventing horizontal movement of the interior unit beyond the second position shown in FIG. 3. These devices are shown in FIG. 5.

Figure 4:
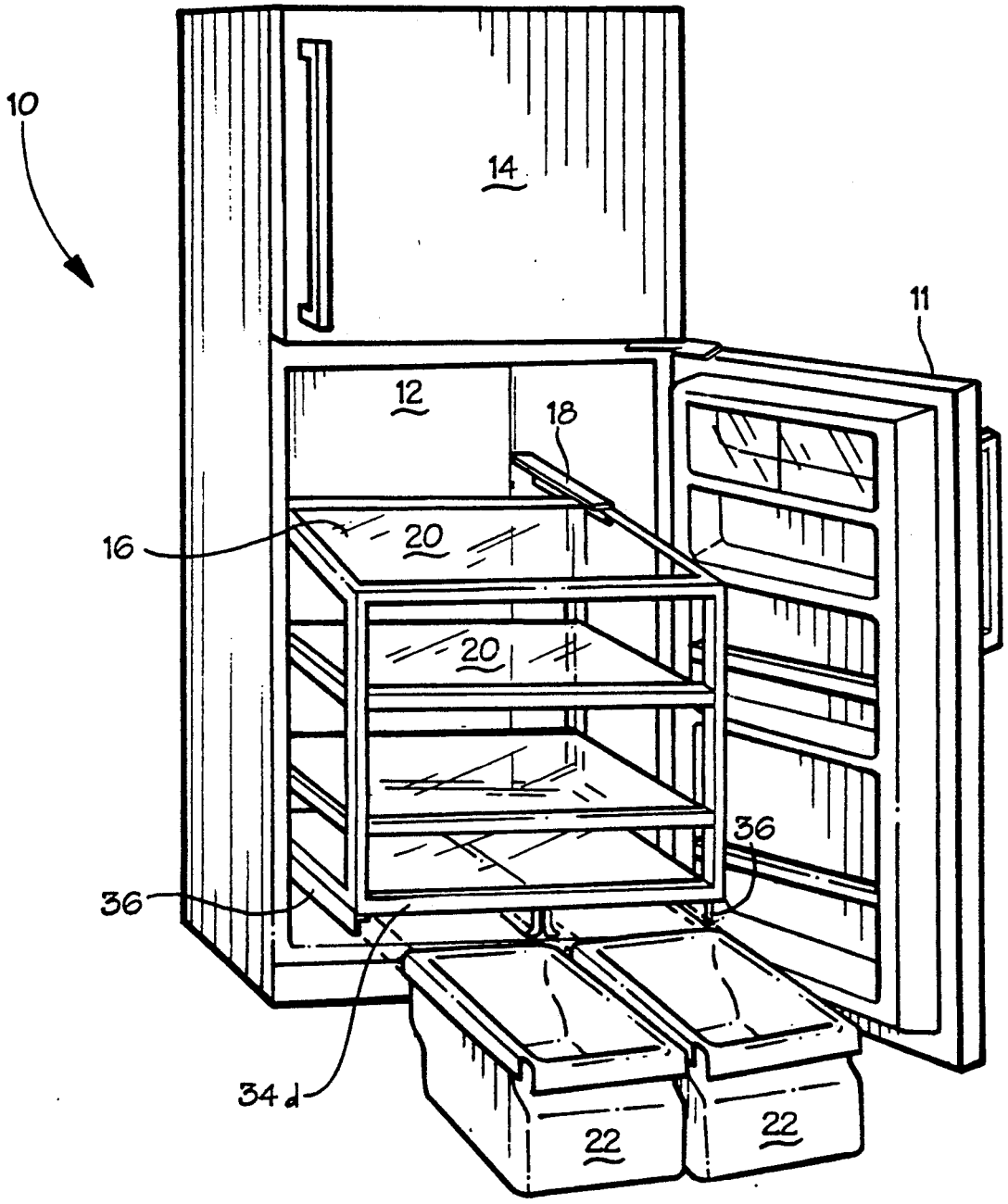
FIG. 4 illustrates the first embodiment of the present invention with the interior unit in the extended position and the bins exploded from the interior unit.

Referring now to FIG. 4, the first embodiment of the present invention is shown with the interior unit 16 in its second, extended, position. The bins 22 are shown in an exploded position with respect to the interior unit 16. A second set of guide rails 36 attached to the lower part of the interior unit 16 is shown. These guide rails allow for movement of the bins 22 from the second extended position to a third, further extended, position and also allow removal of the bins for cleaning.

Figure 5:
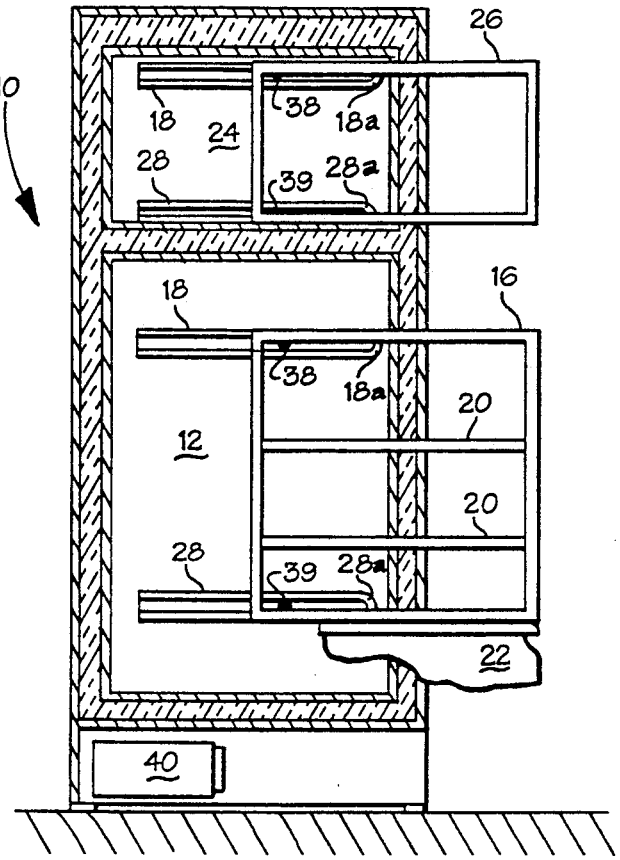
FIG. 5 illustrates a side view of a third embodiment being a combined first and second embodiment of the present invention.

In FIG. 5, a third embodiment of the present invention is shown. In this embodiment, a combination of the first and second embodiments, interior units are found both within the refrigerated section 12 and the freezer section 24. Devices 38 for preventing movement of the interior units 16 and 26 beyond the second extended position are shown in FIG. 5. When the interior units 16 and 26 reach the second, extended, position, device 38 will abut the end of upper guide rail 18 to prevent further movement.

Additionally or alternatively, devices 39 may be placed in the lower portion of the interior units 16 and 26 in order to abut the ends of lower guide rails 28 to also ensure no movement of the interior unit beyond the second extended position. Devices 38 and 39 may be knobs of material large enough to abut the curved ends 18A and 28A of the guide rails 18 and 28.

Figure 6:
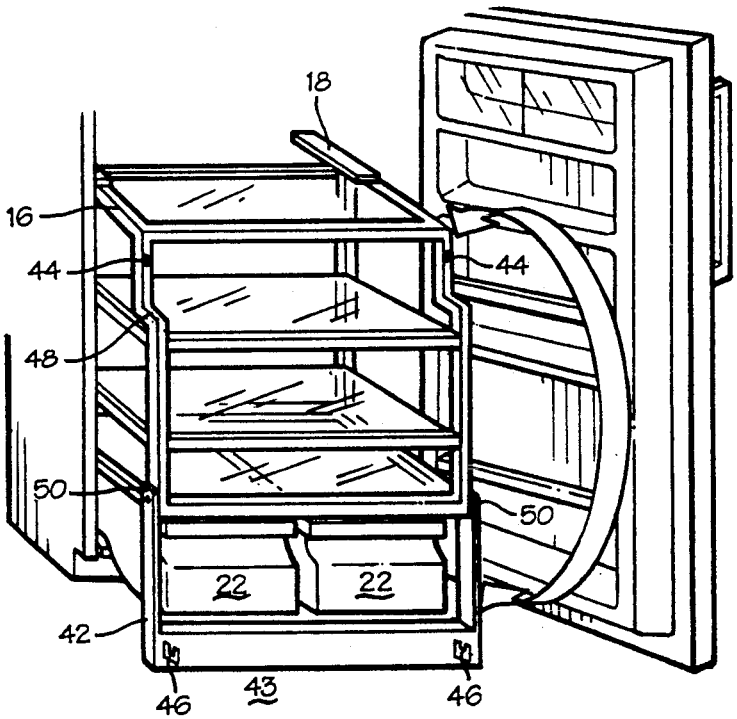
FIG. 6 illustrates a safety brace feature of the present invention.

Also shown in FIG. 5 is the compressor 40 of the refrigerator/freezer 10. Because of the weight of the compressor 40 the extension of either or both interior units 16 and 26 should not cause tipping of the refrigeration unit. However, in some instances it may be advisable and practical to add a safety brace to the refrigerator interior unit 16 to prevent tipping. Such a device is seen in FIG. 6. In FIG. 6, brace 42 is shown in its operative position contacting the floor 43 beneath the bins 22. When in its closed position, the braces may attach to the upper portion of the interior unit 16 through notches 44 into which hooks 46 fit, thereby locking the brace 42 into an upright position away from floor 43. Brace 42 preferably pivots from the operative position to the non operative position via hinges 50. An indentation 48 in the front portion of the interior unit 16 may be provided in order to allow for a flush front surface on the interior unit.

In summary, a refrigerator/freezer having a sliding interior unit in its interior refrigeration or freezer portions in the form of several shelves in superimposed relationship with one another and mounted to a common frame is provided. The invention includes a track assembly for slidably mounting the sliding interior unit in the refrigerator or freezer in lieu of the stationary shelves which are normally mounted in the body of the refrigerator or freezer. A refrigerator/freezer providing easy access to the shelves and bins within the refrigerator or freezer is thereby provided.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A refrigerator having an interior unit where said unit comprises:

first guide rails on either side of the interior of the refrigerator;

a frame having four vertical posts, said four vertical posts being connected by an upper and lower set of support bars, said upper set of support bars having means to connect slidably said frame to said guide rails for horizontal movement of said frame between a first non-extended position and a second extended position and said frame having at least one pair of shelf supports connected to each of said vertical posts;

at least one bin associated with said four vertical posts and said lower set of support bars so as to allow for movement of said bin from said first position to said second position;

means for preventing horizontal movement of said frame beyond said second position; and hinged support means connected to a lower front portion of said frame, said support means operating when said unit is moved from said first position to said second position to pivot forward towards the ground, and to engage the ground to provide added support to the frame when said frame is in its second position.

2. A refrigerator having a pair of spaced vertical side walls, a back wall, a top wall, a bottom wall and an open front wall defining an inner compartment and a door for sealingly closing the open front wall of the inner compartment, further comprising:

a frame having four vertical posts, an upper set of support bars interconnecting the four vertical posts to one another, and a lower set of support bars spaced from the said upper set of support bars and interconnecting said four vertical posts to one another;

a pair of frame guide rails each mounted to a respective one of the spaced vertical side walls of the refrigerator;

means for supporting said frame on said frame guide rails for horizontal movement of said frame between a non-extended position in which said frame is disposed interiorly of the inner compartment of the refrigerator so as to permit the door to sealingly close the inner compartment and an extended position in which said frame extends outwardly through the one open front wall of the inner compartment of the refrigerator;

a frame shelf for support of articles on said frame;

a plurality of individual post support elements each mounted on a respective one of said four vertical posts of said frame, said individual post support elements collectively supporting said frame shelf on all four vertical posts at a predetermined height; and means for selectively adjusting the mounted positions of said individual post support elements on their respective associated vertical posts to thereby reposition said frame shelf at a plurality of different heights on said frame.

3. A refrigerator according to claim 2 and further comprising a pair of bin guide rails mounted to said lower set of support bars, a bin, means for slidably supporting said bin on said bin guide rails for slidable movement of said bin between a first position and a second position in which said bin is extended more laterally outwardly of said frame than in said first position.

4. A refrigerator according to claim 3 and further comprising means for preventing horizontal movement of said frame beyond said extended position.

* * * * *